US011313360B2

(12) United States Patent
Ryu et al.

(10) Patent No.: US 11,313,360 B2
(45) Date of Patent: Apr. 26, 2022

(54) LINEAR COMPRESSOR AND METHOD FOR CONTROLLING LINEAR COMPRESSOR

(71) Applicant: LG ELECTRONICS INC., Seoul (KR)

(72) Inventors: Nayi Ryu, Seoul (KR); Chulgi Roh, Seoul (KR); Gahyun Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 155 days.

(21) Appl. No.: 16/545,541

(22) Filed: Aug. 20, 2019

(65) Prior Publication Data

US 2020/0056603 A1 Feb. 20, 2020

(30) Foreign Application Priority Data

Aug. 20, 2018 (KR) ..... 10-2018-0096913

(51) Int. Cl.

| | |
|---|---|
| ***F04B 35/04*** | (2006.01) |
| ***F04B 49/06*** | (2006.01) |
| ***F04B 39/12*** | (2006.01) |
| ***F25B 31/02*** | (2006.01) |
| ***F25B 1/02*** | (2006.01) |

(52) U.S. Cl.

CPC ..... *F04B 35/04* (2013.01); *F04B 35/045* (2013.01); *F04B 39/12* (2013.01); *F04B 49/06* (2013.01); *F25B 1/02* (2013.01); *F25B 31/023* (2013.01); *F04B 2201/0402* (2013.01); *F05B 2270/303* (2013.01); *F25B 2309/001* (2013.01); *F25B 2400/073* (2013.01); *F25B 2500/04* (2013.01); *F25B 2500/16* (2013.01)

(58) Field of Classification Search

CPC .... F25B 1/02; F25B 31/023; F25B 2400/073; F25B 2309/001; F25B 2500/04; F25B 2500/16; F04B 35/045; F04B 39/12; F04B 49/06; F04B 2201/0402; F04B 35/04

See application file for complete search history.

(56) References Cited

U.S. PATENT DOCUMENTS 8,011,198 B2 * 9/2011 Ishikawa ..... F04B 49/06 62/228.4
8,070,460 B2 * 12/2011 Lee ..... F04B 39/1066 417/211

(Continued)

FOREIGN PATENT DOCUMENTS

JP 2002335692 11/2002
JP 2012057586 3/2012

(Continued)

OTHER PUBLICATIONS

Extended European Search Report in Application No. 19189404.7, dated Oct. 18, 2019, 9 pages.

*Primary Examiner* — Christopher S Bobish
(74) *Attorney, Agent, or Firm* — Fish & Richardson P.C.

(57) ABSTRACT

A linear compressor according to the present disclosure may include a cylinder provided with at least one groove, a piston reciprocating within the cylinder, a motor configured to provide a driving force to move the piston within the cylinder, an inverter configured to perform a switching operation to transmit electric power to the motor, and a controller configured to receive temperature information from the electronic device and control the inverter to preheat the motor based on the received temperature information.

14 Claims, 9 Drawing Sheets

(56) References Cited

U.S. PATENT DOCUMENTS

| | | | | |
|---|---|---|---|---|
| 8,182,245 | B2 * | 5/2012 | Maeda | H02M 7/5387 417/411 |
| 8,616,855 | B2 * | 12/2013 | Burchill | F04B 49/02 417/45 |
| 8,734,125 | B2 * | 5/2014 | McSweeney | F04C 28/28 417/228 |
| 9,791,175 | B2 * | 10/2017 | Senf, Jr. | F25D 11/003 |
| 9,879,894 | B2 * | 1/2018 | Ramayya | F04B 39/02 |
| 10,128,788 | B2 * | 11/2018 | Daugherty, III | H02P 6/14 |
| 2007/0041853 | A1 * | 2/2007 | Hansen | F04B 39/0292 417/417 |
| 2010/0278660 | A1 * | 11/2010 | Burchill | F04B 49/02 417/53 |
| 2011/0083450 | A1 * | 4/2011 | Turner | F25B 31/004 62/56 |
| 2011/0113797 | A1 * | 5/2011 | Peyaud | F25B 49/02 62/115 |
| 2012/0056571 | A1 * | 3/2012 | Buse | F04B 49/10 318/558 |
| 2016/0017876 | A1 * | 1/2016 | Kim | F04B 35/045 417/443 |

FOREIGN PATENT DOCUMENTS

| | | |
|---|---|---|
| JP | 5288411 | 9/2013 |
| KR | 1020040101765 | 12/2004 |
| KR | 100851905 | 8/2008 |
| KR | 1020160000324 | 1/2016 |
| KR | 1020170123042 | 11/2017 |

* cited by examiner

LINEAR COMPRESSOR AND METHOD FOR CONTROLLING LINEAR COMPRESSOR

CROSS-REFERENCE TO RELATED APPLICATION

Pursuant to 35 U.S.C. § 119(a), this application claims the benefit of earlier filing date and right of priority to Korean Application No. 10-2018-0096913, filed on Aug. 20, 2018, the contents of which is incorporated by reference herein in its entirety.

BACKGROUND OF THE INVENTION

1. Field of the Invention

The present disclosure relates to a linear compressor and a control method thereof.

2. Description of the Related Art

In general, a compressor is an apparatus for converting mechanical energy into compressive energy of a compressible fluid, and used as a part of a refrigerating appliance, for example, a refrigerator or an air conditioner.

Compressors are largely divided into reciprocating compressors, rotary compressors, and scroll compressors. In the reciprocating compressor, a compression space in which working gas is sucked or discharged is formed to compress refrigerant between a piston and a cylinder while the piston linearly reciprocates in the cylinder. In the rotary compressor, a compression space in which working gas is sucked or discharged is formed between a roller and a cylinder being eccentrically rotated to compress refrigerant while the roller eccentrically rotates along an inner wall of the cylinder. In the scroll type compressor, a compression space in which working gas is sucked or discharged is formed between an orbiting scroll and a fixed scroll to compress refrigerant while the orbiting scroll is rotated along the fixed scroll.

The reciprocating compressor sucks, compresses, and discharges refrigerant gas by linearly reciprocating the inner piston within the cylinder. The reciprocating compressors are largely divided into recipro methods and linear methods according to the method of driving the piston.

The recipro method is a method of coupling a crankshaft to a rotating motor, and coupling a piston to the crankshaft to convert a rotational movement of the motor into a linear reciprocating movement. On the contrary, the linear method refers to a method of connecting a piston to a mover of a linearly moving motor to reciprocate the piston by a linear movement of the motor.

Such a reciprocating compressor includes an electric motor unit for generating a driving force and a compression unit for receiving a driving force from the transmission unit and compressing the fluid. A motor is generally used as the electric motor unit, and a linear motor is used in the case of the linear method.

In the case of the linear motor, the motor itself directly generates a linear driving force, and thus a mechanical conversion device is not required and the structure is not complicated. In addition, the linear motor has features capable of reducing loss due to energy conversion and greatly reducing noise because there is no joint where friction and abrasion occur. Furthermore, when a linear type reciprocating compressor (hereinafter referred to as a linear compressor) is used for a refrigerator or an air conditioner, a stroke voltage applied to the linear compressor may be changed to change compression ratio, and thus it may be used for variable control of freezing capacity.

Typically, a linear compressor is configured such that a piston is linearly reciprocated within a cylinder by the linear motor in a closed shell to suck and compress, and then discharge refrigerant.

The linear motor is configured such that a permanent magnet is located between an inner stator and an outer stator, and the permanent magnet is driven to linearly reciprocate by a mutual electromagnetic force between the permanent magnet and the inner (or outer) stator. Furthermore, as the permanent magnet is driven in a state of being connected to the piston, the piston linearly reciprocates within the cylinder to suck and compress and then discharge the refrigerant.

In connection with such a linear compressor, Korean Patent Publication No. 10-2016-0000324 (published on Jan. 4, 2016) discloses a gas bearing technology that supplies refrigerant gas to a space between the cylinder and the piston to perform a bearing function. The refrigerant gas flows through a nozzle of the cylinder to an outer circumferential surface of the piston to perform a bearing action with respect to the reciprocating piston.

Furthermore, Korean Patent Publication No. 10-2017-0123042 (published on Nov. 7, 2017) discloses a linear compressor in which the position of a groove provided in a cylinder is optimized to improve the performance of a gas bearing supplied to the piston.

On the other hand, when the groove formed in the cylinder of the linear compressor is clogged by various substances, a gas that floats up the piston cannot pass through the hole, thereby causing friction between the piston and the cylinder. When friction occurs between the piston and the cylinder, it may reduce an operation efficiency of the linear compressor as well as wear out the piston.

The groove of the cylinder may be clogged by foreign matter generally introduced from the outside and oil injected into the compressor. At present, the structure of the linear compressor is designed to prevent foreign matter or oil from being introduced into the groove, but it is insufficient to completely block foreign matter and oil.

Therefore, there is a need for a control method of a linear compressor capable of preventing the groove of the cylinder from being blocked in order to increase the operation efficiency of the linear compressor and prevent the wear of the piston.

SUMMARY OF THE INVENTION

A technical task of the present disclosure is to solve the foregoing problems of a linear compressor in the related art, and an object of the present disclosure is to provide a linear compressor capable of preventing a groove of a cylinder from being clogged and a control method thereof.

In particular, a technical task of the present disclosure is to provide a linear compressor for determining whether or not the temperature around the linear compressor corresponds to a low temperature condition by various methods, and preheating the linear compressor according to the determination result to secure the groove opening of the cylinder and a control method thereof.

Furthermore, a technical task of the present disclosure is to provide a linear compressor for performing a preheating operation prior to performing a normal operation according to a temperature condition and a control method thereof.

In order to solve the foregoing tasks, a linear compressor disclosed herein may include a cylinder provided with at least one groove, a piston reciprocating within the cylinder, a motor configured to provide a driving force to move the piston within the cylinder, an inverter configured to perform a switching operation to transmit electric power to the motor, and a controller configured to receive temperature information from the electronic device and control the inverter to preheat the motor based on the received temperature information.

According to an embodiment, the controller may preheat the motor while the piston is stopped to increase the temperature of the linear compressor when the power of the electronic device is activated.

Specifically, the controller may control the inverter to allow a DC current of a predetermined magnitude to flow through the motor so as to preheat the motor.

According to an embodiment, the linear compressor may further include a sensing unit configured to sense a motor current flowing through the motor, wherein the controller adjusts an output voltage of the inverter based on the motor current sensed by the sensing unit subsequent to applying a DC current to the motor.

According to an embodiment, the controller may set a target DC current value for controlling a preheating operation of the motor, and control the inverter to increase the output voltage of the inverter when the motor current sensed by the sensing unit is less than the target DC current.

According to an embodiment, the controller may control the inverter to block the output of the inverter when the motor current sensed by the sensing unit is higher than a preset trip level subsequent to applying the DC current to the motor.

According to an embodiment, the controller may control the inverter to allow an AC current above a preset reference frequency to flow through the motor so as to preheat the motor.

According to an embodiment, the temperature information may include a temperature value related to a location of the electronic device, and the controller may compare the temperature value with a preset reference temperature, and preheat the motor based on the comparison result.

According to an embodiment, the temperature value may be measured by a temperature sensor provided in the electronic device, and the controller may preheat the motor prior to operating the motor according to a predetermined compressor command when the temperature value is lower than the reference temperature.

According to an embodiment, the controller may receive temperature information from any one temperature sensor disposed at a position closest to the linear compressor among a plurality of temperature sensors provided in the electronic device.

According to an embodiment, when a control command for starting the operation of the linear compressor is generated, the controller may determine whether or not to preheat the motor using temperature information received within a predetermined period of time from the time of generating the control command.

According to an embodiment, the controller may update temperature information for each predetermined offset period of time after the preheating operation of the motor is started, and end the preheating operation of the motor based on the comparison result of a temperature value included in the updated temperature information and the reference temperature.

According to an embodiment, the controller may end the preheating operation of the motor when a period of time of the preheating operation of the motor exceeds a preset reference period of time.

According to an embodiment, the controller may decrease a carrier frequency applied to the inverter when the temperature value is less than the reference temperature.

According to an embodiment, the controller may control the inverter to allow the piston to reciprocate within the cylinder based on an operation mode of the electronic device, without performing a preheating operation of the motor when the temperature value is above the reference temperature.

According to an embodiment, the controller may control the inverter to allow the piston to reciprocate within the cylinder based on an operation mode of the electronic device when the preheating of the motor ends.

Furthermore, according to another embodiment of the present invention, a temperature around the linear compressor may be estimated using a motor current and a motor voltage measured by the sensing unit of the linear compressor Specifically, the controller may detect a resistance value of the motor using the motor voltage and the motor current sensed by the sensing unit, and control the inverter to preheat the motor based on the detected resistance value.

At this time, the controller may monitor a resistance value of the motor at predetermined intervals after the preheating operation of the motor is started, and perform a preheating operation of the motor until the resistance value of the motor increases above the reference resistance value.

The linear compressor according to the present disclosure performs a preheating operation prior to performing a reciprocating movement of the piston, thereby obtaining an effect of preventing a groove formed in the cylinder from being clogged.

Furthermore, according to the present disclosure, a preheating operation for increasing the temperature of the linear compressor prior to moving the piston of the linear compressor may be carried out, thereby preventing friction or collision between the piston and the cylinder.

Accordingly, the linear compressor according to the present disclosure has an advantage capable of securing the operation performance of the compressor even under a low temperature condition.

In addition, according to the present disclosure, the performance of the gas bearing may be secured to minimize the wear of the piston, thereby obtaining an effect of increasing the life of the mechanism and parts of the linear compressor.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The invention disclosed in the present specification may be applicable to a control apparatus of a linear compressor and a control method of a linear compressor.

In describing technologies disclosed herein, moreover, the detailed description will be omitted when specific description for publicly known technologies to which the invention pertains is judged to obscure the gist of the present invention. In addition, it should be noted that the accompanying drawings are merely illustrated to easily explain the technological concept disclosed herein, and therefore, they should not be construed to limit the technological concept by the accompanying drawings.

Figure 1:
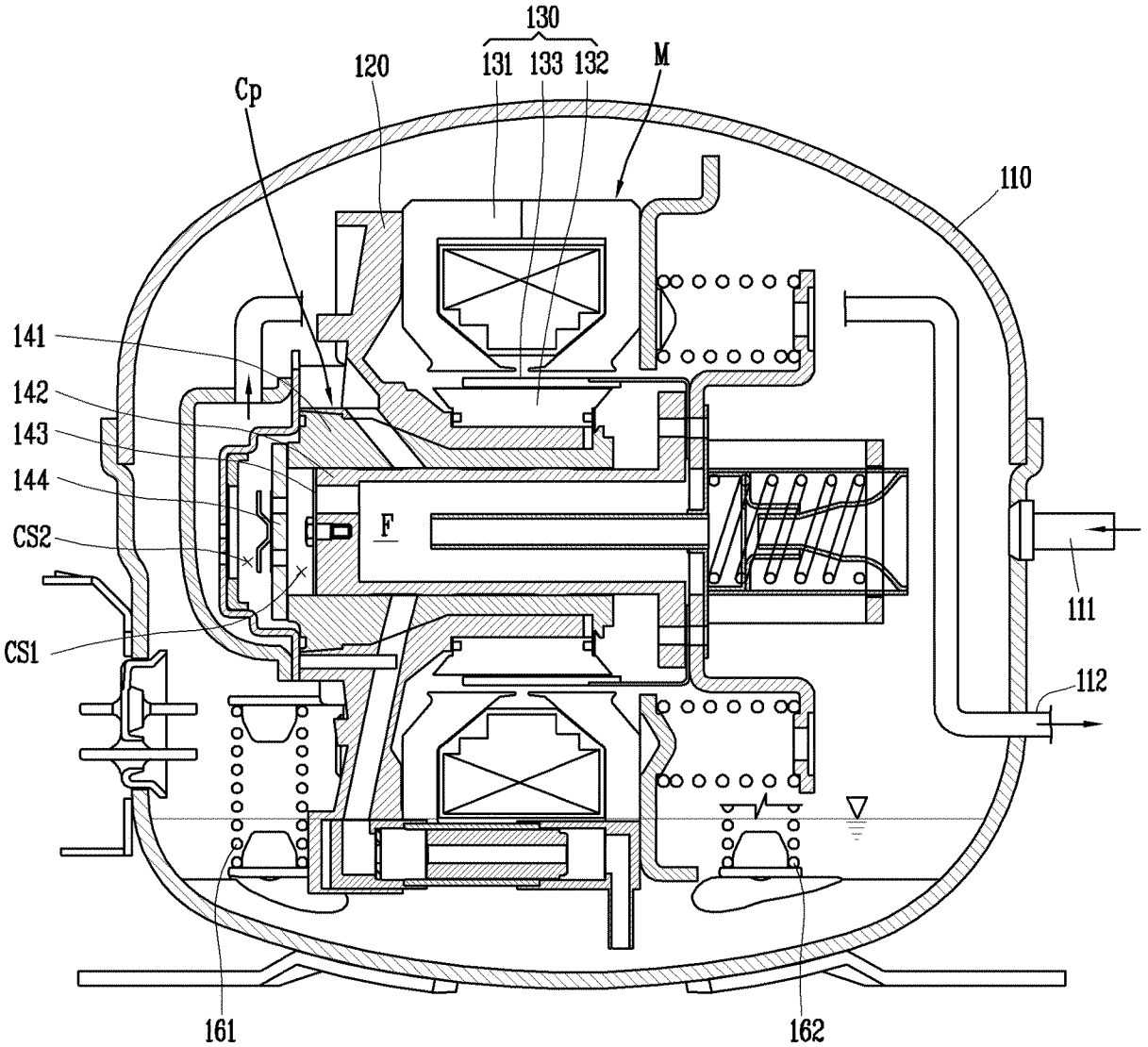
FIG. 1 is a cross-sectional view showing an embodiment of a linear compressor according to the present disclosure.

FIG. 1 illustrates a cross-sectional view of a linear compressor according to the present disclosure.

A linear compressor according to an embodiment of the present disclosure may be a linear compressor to which a linear compressor control apparatus or a compressor control apparatus, is applicable, but may also include any type or form of a linear compressor. The linear compressor according to an embodiment of the present disclosure illustrated in FIG. 1 is merely one example, and not intended to limit the scope of the present disclosure.

In general, a motor applied to a compressor is provided with a winding coil on a stator and a magnet on a mover such that the mover rotates or reciprocates by an interaction between the winding coil and the magnet.

The winding coils can be formed in various ways according to the type of the motor. For example, in the case of a rotary motor, a plurality of slots formed along the circumferential direction on an inner circumferential surface of the stator are wound in a concentric or distributed manner, and in the case of a reciprocating motor, a coil is wound in an annular shape to form a winding coil, and then a plurality of core sheets are inserted and coupled along the circumferential direction on an outer circumferential surface of the winding coil.

In particular, in the case of a reciprocating motor, since the coil is wound in an annular shape to form a winding coil, the coil is wound around an annular bobbin made of a plastic material to form a winding coil.

As illustrated in FIG. 1, the reciprocating compressor has a structure in which a frame 120 is resiliently provided by a plurality of support springs 161, 162 in an inner space of a sealed shell 110. A suction pipe 111 connected to an evaporator (not shown) of the refrigeration cycle is provided to communicate with the inner space of the shell 110, and a discharge pipe 112 connected to a condenser (not shown) of the refrigeration cycle device is provided to communicate with one side of the suction pipe 111.

An outer stator 131 and an inner stator 132 of the reciprocating motor 130 constituting an electric motor unit (M) are fixedly mounted on the frame 120, and a mover 133 for performing a reciprocating movement is provided between the outer stator 131 and the inner stator 132. A piston 142 constituting a compression unit (Cp) together with a cylinder 141, which will be described later, is coupled to the mover 133 of the reciprocating motor 130 so as to reciprocate.

The cylinder 141 is provided in a range overlapping with the stators 131, 132 of the reciprocating motor 130 in an axial direction. Furthermore, a compression space (CS1) is formed in the cylinder 141, and a suction flow path (F) for guiding refrigerant to the compression space (CS1) is formed in the piston 142, and the suction flow path (F) is formed at an end of the suction flow path (F), and a discharge valve 144 for opening and closing the compression space (CS1) of the cylinder 141 is provided on a front end side of the cylinder 141.

For reference, a discharge unit of the linear compressor according to the present disclosure may be formed in various shapes. For example, the linear compressor according to the present disclosure may include a discharge unit formed with a valve plate, as illustrated in FIG. 1. In another example, the linear compressor may include a discharge unit (not shown) having an elastic member.

Figure 2:
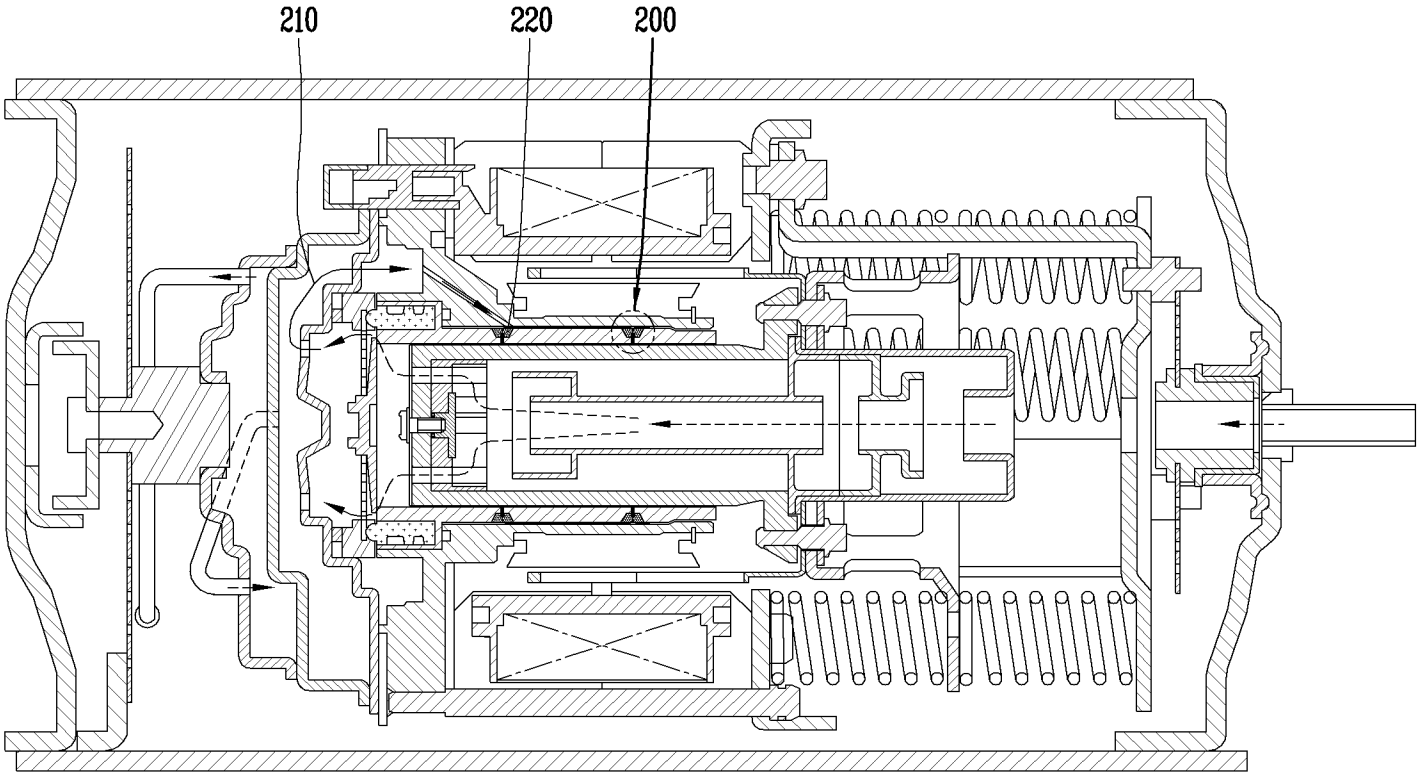
FIG. 2 is a cross-sectional view showing a cylinder of a linear compressor and a hole provided therein according to the present disclosure.

Hereinafter, the flow 210 of gas within the cylinder 141 of the linear compressor is illustrated in FIG. 2.

As illustrated in FIG. 2, gas compressed within the cylinder passes through the compression space (CS1), and passes through the hole 220 formed in the cylinder along a flow path formed on an outer circumferential surface of the cylinder.

When a flow path is formed so as to form the flow 210 of gas in this manner, the gas is blown from the cylinder toward the piston side, so that the piston floats up from an inner wall of the cylinder. Such a technology is defined as a gas bearing technology since it implements the role performed by bearings using the injection of gas.

As illustrated in FIG. 2, at least one hole 220 may be formed in the cylinder 141. Specifically, the hole 220 may be configured to be recessed radially inward from an outer circumferential surface of the cylinder 141. Furthermore, the hole 220 may have a circular shape along an outer circumferential surface of the cylinder 141 with respect to the center axis in an axial direction.

Referring to FIG. 2, foreign matter 200 such as oil or dust may exist in the hole 220. As the flow 210 of gas illustrated in FIG. 2 is maintained for a long time, when the amount of foreign matter 200 accumulated in the holes 220 increases, the holes 220 may be blocked.

In order to prevent such blocking in advance, a filter (not shown) may be provided in the hole 220 or the housing sealing structure of the linear compressor is improved, but the clogging phenomenon of the hole 220 may still occur.

When the groove 220 is clogged by the accumulation of the foreign matter 200, gas floating up the piston is unable to pass through the hole 220, and thus friction occurs between the piston and the cylinder. When friction occurs between the piston and the cylinder, it may reduce an operation efficiency of the linear compressor as well as wear out the piston.

On the other hand, in order to prevent the clogging phenomenon of the hole 220, it is required to reduce the viscosity of the oil in consideration of the fact that the main component of the foreign matter 200 accumulated in the hole 220 is oil within the compressor.

In other words, as the viscosity of the oil is increased, the possibility of clogging of the holes 220 increases, and therefore, the linear compressor proposed in the present disclosure performs a preheating operation when the starting point of the compressor operation is a low temperature condition, thereby reducing the viscosity of the foreign matter 200 that may exist within the linear compressor.

Hereinafter, a linear compressor capable of preventing the clogging phenomenon of the hole 220 and a control method thereof will be described.

Figure 3:
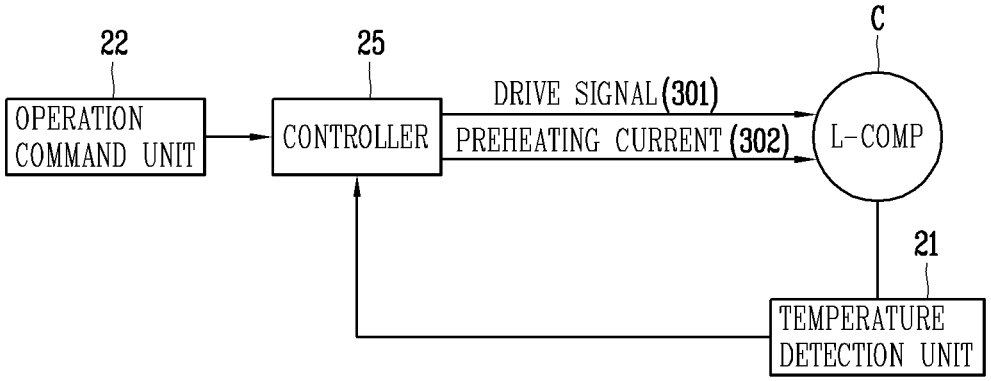
FIG. 3 is a block diagram showing the components of a linear compressor according to the present disclosure.

First, FIG. 3 illustrates a block diagram showing components associated with the control of a linear compressor according to the present disclosure.

As illustrated in FIG. 3, the linear compressor may include a temperature detection unit 21, an operation command unit 22, and a controller 25. Here, the controller 25 is defined as a component that generates various control commands associated with the operation of the linear compressor. Therefore, the controller 25 may be configured separately from a control apparatus of an electronic device (ex. refrigerator) having the linear compressor.

First, the temperature detection unit 21 may detect temperature information associated with the temperature of the linear compressor. The temperature detection unit 21 may detect temperature information using a temperature sensor, receive temperature information from an electronic device provided with a linear compressor, or estimate temperature information by calculating a resistance value of the motor.

In one embodiment, the temperature detection unit 21 may have a temperature sensor for measuring temperature by itself. The temperature sensor included in the temperature detection unit 21 may measure temperature at the point where the temperature sensor is provided, and output the measured temperature to the controller 25. For example, the temperature sensor included in the temperature detection unit 21 may be provided within a predetermined distance from the groove 220 formed in the cylinder.

In another embodiment, the temperature detection section 21 may also include a communication unit (not shown) for receiving temperature information from an electronic device provided with a linear compressor. The communication unit of the temperature detection unit 21 may receive temperature information processed in the electronic device.

Specifically, the temperature information processed in the electronic device may include a temperature value measured by a temperature sensor provided in the electronic device. When a plurality of temperature sensors are arranged in the electronic device, the communication unit of the temperature detection unit 21 may receive temperature information including a plurality of temperature values. The controller 25 may determine whether or not to preheat the motor using a temperature value measured by any one of a plurality of temperature sensors which is located closest to the linear compressor.

On the other hand, the temperature information received by the communication unit through the electronic device may include weather information received by the electronic device from the server. In other words, even when the electronic device does not have the temperature sensor by itself, the communication unit of the temperature detection unit 21 may receive the weather information when processing the weather information received through an external server.

In another embodiment, the temperature detection unit 21 may include a sensing unit (not shown) for sensing a motor current and a motor voltage. The sensing unit may measure the motor current and the motor voltage, and may transmit the measured values to the controller 25. The controller 25 may measure an impedance of the motor by the sensing unit. The controller 25 may estimate the temperature based on an impedance measurement value.

Specifically, the sensing unit may include a voltage detection unit that detects a motor voltage applied to the motor, and a current detection unit that detects a motor current applied to the motor. The voltage detection unit and the current detection unit may transmit information related to the detected motor voltage and the motor current to the controller 25. Since the voltage detection unit and the current detection unit are well-known, the detailed description thereof will be omitted.

The controller 25 may include table information for recording an impedance change according to a temperature change, and may compare the measured impedance value with the table information to estimate a temperature value.

On the other hand, the controller 250 may calculate a stroke estimation value using the detected motor current, motor voltage, and motor parameter.

Here, the controller 25 may calculate a stroke estimation value through the following equation 1.

$$x = \frac{1}{\alpha}\int\left(V_m - Ri_m - L\frac{di_m}{dt}\right)dt \qquad \text{[Equation 1]}$$

Here, x, α, Vm, im, R and L denote a stroke, a motor constant or a back electromotive force constant, a motor voltage, a motor current, a resistance, and an inductance, respectively.

The controller 25 may compare a stroke command value set according to the operation mode of the linear compressor with a stroke estimate value calculated by Equation 1, and vary a voltage applied to the motor based on the comparison result to control the stroke.

In other words, the controller 25 decreases a motor-applied voltage when the stroke estimate value is larger than the stroke command value, and increases the motor-applied voltage when the stroke estimate value is smaller than the stroke command value.

In addition, the controller 25 may control the motor to change the movement direction of the piston 142.

For reference, the piston 142 of the linear compressor linearly performs a reciprocating movement in the cylinder 141, and thus moves in a direction approaching the discharge valve 144 or in a direction away from the discharge valve 144.

The piston 142 that performs a reciprocating movement converts its movement direction at two points, and one of the two points closest to the discharge valve 144 is defined as a top dead center (TDC), and the other one as a bottom dead center (BDC). According to this definition, a distance between the top dead center (TDC) and bottom dead center (BDC) corresponds to the stroke of the piston.

The controller 25 may detect whether or not the piston has reached the top dead center using the stroke calculated by Equation 1, the motor current, and the motor voltage.

Specifically, the controller 25 may detect a phase difference between the motor current measured by the sensing unit and the stroke calculated by Equation 1, and monitors a change of the phase difference to determine whether or not the piston reaches the top dead center (TDC).

Specifically, the controller 25 may calculate the phase difference between the motor current and the stroke, and determine that the piston reaches the top dead center (TDC) when the phase difference forms an inflection point.

The operation command unit 22 may output a stroke command value of the piston, and the stroke command value may be transmitted to the controller 25. The operation command unit 22 may set the stroke command value in accordance with the operation mode of the electronic device provided with the linear compressor. For an example, the operation command unit 22 may be a configuration substantially corresponding to the controller 25 or a configuration mounted in the controller 25.

Referring to FIG. 3, the controller 25 may output a drive signal 301 for moving the piston of the linear compressor or output a signal for generating a preheating current 302 to generate heat from the motor in a state where the piston is stopped.

Figure 4:
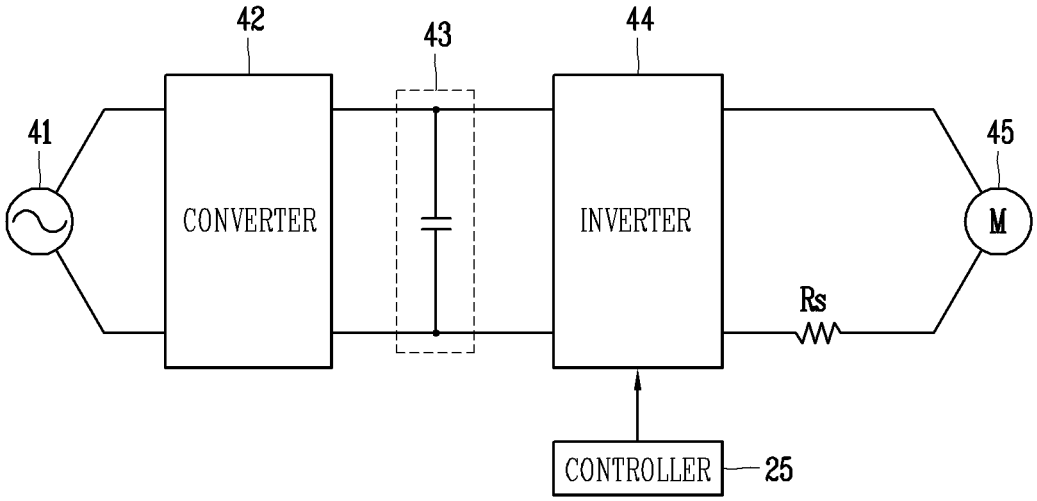
FIG. 4 is a block diagram showing a circuit configuration of the linear compressor illustrated in FIG. 3.

Referring to FIG. 4, a circuit configuration for driving the motor 45 of the linear compressor is illustrated.

The circuit for driving the motor 45 may include a power supply unit 41, a converter 42, a DC link capacitor 43, an inverter 44, a controller 25 and a shunt resistor (Rs).

Specifically, the converter 42 may convert input AC power to DC power to output the converted DC power to the DC link capacitor. A DC link capacitor 43 connected to the DC terminal of the converter 42 to store pulsating DC power from the converter 42 may be provided at one side of the converter 42.

The inverter 44 may include an upper arm switching element and a lower arm switching element to adjust a voltage applied to the motor 45 by a switching operation. In other words, the controller 25 may control the inverter 44 to apply a DC voltage or an AC voltage to the motor 45.

Specifically, the controller 25 may control a duty ratio of the switching element included in the inverter 44 to perform a boost operation, a power factor improvement, and a DC power conversion.

The DC link capacitor 43 may smooth the input power and store it. In the drawing, one element is illustrated as a DC link capacitor 43, but a plurality of elements may be provided to secure element stability. Pulsating DC power from the DC link capacitor 43 is converted into AC power, and the converted AC power may be output to the motor 45.

In addition, the controller 25 may detect a motor current flowing through the motor using a shunt resistor (Rs). Specifically, the controller 25 may detect a magnitude of current flowing through the shunt resistor (Rs) using the output of the voltage detection unit (not shown) that detects a voltage between of both ends of the shunt resistor (Rs).

Hereinafter, in FIGS. 5 through 14, a control method of the foregoing linear compressor will be described.

Figure 5:
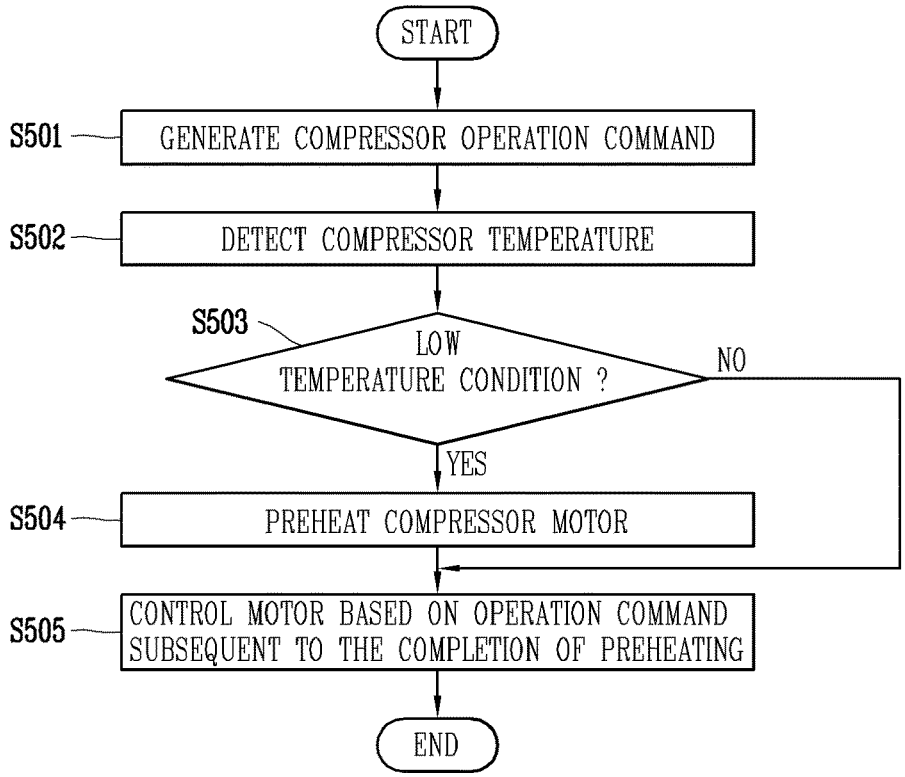
FIG. 5 is a flowchart showing a control method of a linear compressor according to the present disclosure.

Referring to FIG. 5, the operation command unit 22 may generate an operation command of the linear compressor (S501). Specifically, the operation command unit 22 may generate an operation command for the linear compressor based on an operation mode of the electronic device provided with the linear compressor. Here, the operation command may include a stroke command value.

For an example, when the power of the electronic device is activated, an operation command of the compressor may be generated.

For another example, when the operation mode of the electronic device is changed, an operation command of the compressor may be generated, or an operation command of the compressor that has already been generated may be changed.

When a command for operating the compressor is generated, the temperature detection unit 21 may detect temperature information associated with the compressor (S502).

For an example, the temperature detection unit 21 may detect an ambient temperature of the linear compressor.

For another example, the temperature detection unit 21 may detect a surface temperature of the cylinder the linear compressor.

For still another example, the temperature detection unit 21 may detect a temperature of the electronic device provided with the linear compressor.

For yet still another example, the temperature detection unit 21 may detect a temperature of the place of the electronic device provided with the linear compressor.

A method of allowing the temperature detection unit 21 to detect temperature information associated with the linear compressor will be described in more detail in FIGS. 6 and 7.

The controller 25 may determine whether or not the temperature information detected by the temperature detection unit 21 satisfies a preset low temperature condition (S503). Specifically, the controller 25 may determine whether or not a temperature value included in the temperature information detected by the temperature detection unit 21 satisfies a preset low temperature condition.

Here, the low temperature condition may denote a condition capable of increasing the viscosity of oil existing around the cylinder of the linear compressor to a predetermined value or more. Under such a low temperature condition, a hole formed in the cylinder may be clogged with foreign matter or oil existing around the hole, and thus the present disclosure proposes a linear compressor that performs a preheating operation of the motor when it is determined as a low temperature condition.

Referring to FIG. 5, when it is determined that the detected temperature information satisfies a low temperature condition, the controller 25 may control the linear compressor to perform a preheating operation of the motor (S504).

For example, when the power of an electronic device provided with a linear compressor is activated under a low temperature condition, the controller 25 may preheat the motor while the piston is stopped to increase the temperature of the linear compressor. Here, the electronic device provided with the linear compressor may be implemented in various forms such as a refrigerator, a laundry treating apparatus, an air conditioner, an air purifier or the like.

In other words, when an operation command for the linear compressor is generated under a low temperature condition, the controller 25 may perform a preheating operation to increase the temperature of the motor by a predetermined value prior to moving the piston according to the generated operation command.

In addition, after the preheating operation of the motor is completed, the controller 25 may control the motor based on the generated operation command (S505). When the detected temperature information does not satisfy a low temperature condition, the controller 25 may perform the process (S505) of immediately controlling the motor based on the operation command without performing a preheating operation of the motor.

In one embodiment, when the detected temperature information does not satisfy a low temperature condition, the controller 25 may control the inverter to allow the piston to reciprocate within the cylinder based on an operation mode of the electronic device, without performing a preheating operation of the motor.

Furthermore, even after the preheating operation is completed, the controller 25 may control the inverter to reciprocate the piston in the cylinder based on the operation mode of the electronic device.

Figure 6:
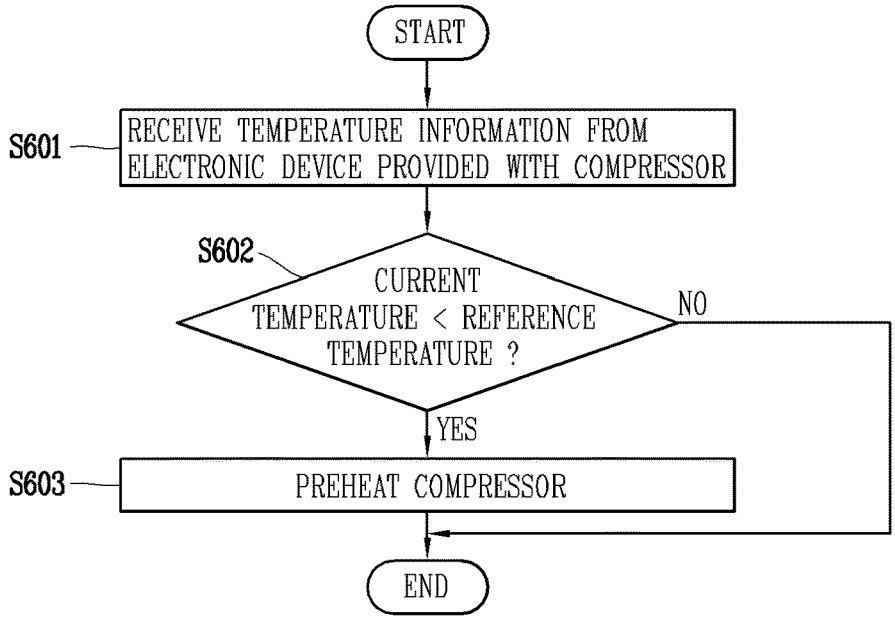
FIG. 6 is a flowchart showing a control method of a linear compressor according to the present disclosure.

In FIG. 6, an embodiment related to a method of detecting temperature information will be described.

The temperature detection unit 21 may include a communication unit (not shown) for performing communication with an electronic device provided with a linear compressor, and the communication unit may receive temperature information processed in the electronic device from the electronic device (S601).

For an example, the temperature information received from the electronic device may include a temperature value associated with the location of the electronic device. In other words, the temperature information may include a temperature value related to a place where the electronic device is installed. In this case, the temperature information may include a temperature value measured by a temperature sensor disposed at a place where the electronic device is installed.

For another example, the temperature information received from the electronic device may include a temperature value measured by a temperature sensor provided in the electronic device. When the electronic device includes a plurality of temperature sensors, the temperature information may include a plurality of temperature values measured by the plurality of temperature sensors.

For still another example, the temperature information received from the electronic device may include weather information received from an external server by the electronic device.

The controller 25 may determine whether or not the current temperature is smaller than a preset reference temperature using the temperature information received from the electronic device by the temperature detection unit 21 (S602).

In one embodiment, the controller 25 may compare a preset reference temperature with a temperature value associated with the location of the electronic device included in the temperature information.

In another embodiment, when the temperature information includes a plurality of temperature values measured by a plurality of temperature sensors provided in the electronic device, the controller 25 may compare a temperature value measured by any one of the plurality of temperature sensors, which is disposed at a position closest to the linear compressor, with a preset reference temperature.

According to the foregoing embodiments, the controller 25 may determine whether or not the current temperature is lower than a preset reference temperature.

Moreover, when the current temperature is lower than a preset reference temperature, the controller 25 may preheat the motor (S603).

In other words, according to an embodiment illustrated in FIG. 6, the controller 25 may control the inverter to receive temperature information from the electronic device and operate the motor in a preheating manner based on the input temperature information. At this time, the temperature information received from the electronic device may include at least one of a temperature value measured by a temperature sensor provided in the electronic device, temperature information related to the installation location of the electronic device, and weather information related to the location.

On the other hand, when a control command for starting the operation of the linear compressor is generated, the controller 25 may determine whether or not to preheat the motor using the temperature information received within a predetermined period of time from the generation time of the control command.

Figure 7:
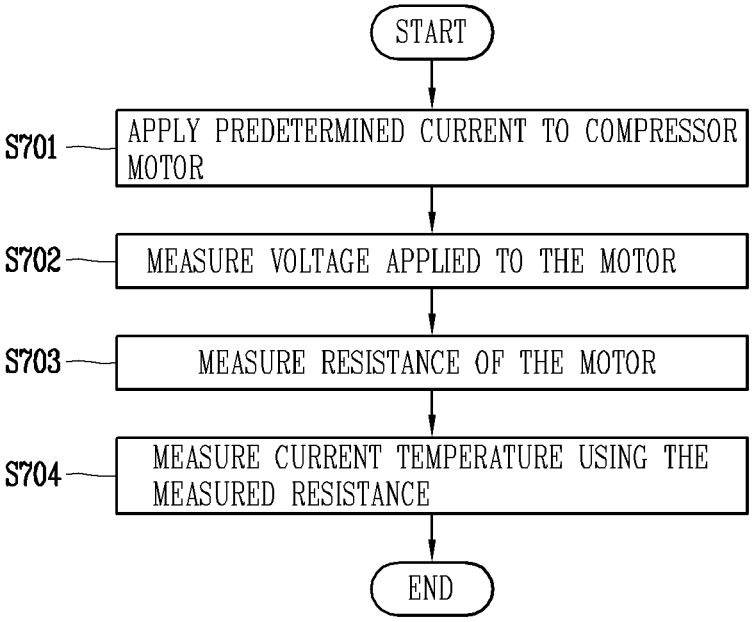
FIG. 7 is a flowchart showing a control method of a linear compressor according to the present disclosure.

In FIG. 7 below, another embodiment related to a method of detecting temperature information will be described.

When temperature information related to the linear compressor is required, the controller 25 may apply a predetermined current to the motor (S701).

After a predetermined current is applied to the motor, the controller 25 may control the sensing unit to measure a voltage applied to the motor (S702).

In addition, the controller 25 may measure a resistance value of the motor using the motor voltage and the motor current (S703).

The controller 25 may measure the current temperature of the linear compressor using the measured resistance value (S704).

In general, an impedance value of a resistor constituting the circuit varies depending on the ambient temperature, and therefore, the controller 25 may calculate the resistance value of the motor by sensing the motor current and the motor voltage, thereby estimating a temperature around the motor.

In one embodiment, the controller 25 may control the inverter to perform a preheating operation of the motor when the detected resistance value is smaller than a preset reference resistance value.

In other words, since the resistance value of the motor decreases as the ambient temperature decreases, the controller 25 may determine that the surrounding environment of the linear compressor corresponds to a low temperature condition when the detected resistance value is smaller than a preset reference resistance value.

On the other hand, the controller 25 may include a memory (not shown) for storing a table for recording temperature characteristics related to the resistance of the motor, and detect a temperature value corresponding to the measured resistance value based on the information recorded in the table.

As described above, when detecting the ambient temperature of the linear compressor by calculating the resistance, the linear compressor does not need to have an additional temperature sensor or to receive additional temperature information from the electronic device.

In other words, the controller 25 that performs the method shown in FIG. 7 may detect a resistance value of the motor using the output of the sensing unit that senses the motor current and the motor voltage, and control the inverter to preheat the motor based on the detected resistance value.

In one embodiment, the controller 25 may control the inverter to perform a preheating operation of the motor when the detected resistance value is smaller than a preset reference resistance value.

In particular, the controller 25 may monitor the resistance value of the motor at predetermined intervals after the preheating operation is started, and perform the preheating operation of the motor until the resistance value of the motor increases above the reference resistance value.

Figure 8:
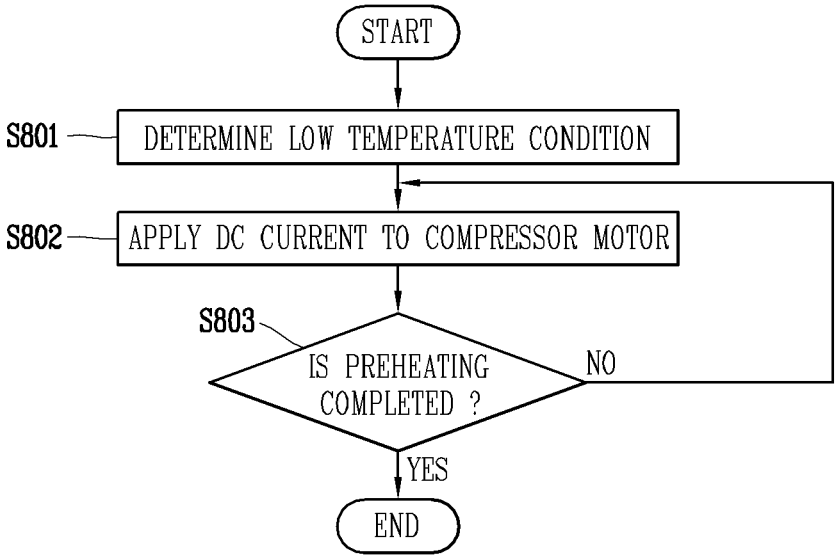
FIG. 8 is a flowchart showing a control method of a linear compressor according to the present disclosure.

In FIG. 8 below, an embodiment of the preheating operation for preheating the motor will be described.

Referring to FIG. 8, the controller 25 may determine whether or not the operating condition of the linear compressor satisfies a preset low temperature condition using the method illustrated in FIGS. 5 through 7 (S801).

Specifically, when it is determined that the operating condition of the linear compressor satisfies a preset low temperature condition, the controller 25 may preheat the motor while the piston is stopped to increase the temperature of the linear compressor.

In one embodiment, the controller 25 may determine whether or not the operating condition of the compressor satisfies a predetermined low temperature condition prior to operating the linear compressor according to an operation command when the power of the electronic device is activated.

In another embodiment, when an operation command corresponding to the linear compressor is generated in the stop state of the linear compressor, the controller 25 may determine whether or not the operating condition of the compressor satisfies a preset low temperature condition prior to operating the linear compressor according to an operation command.

In another embodiment, the controller 25 may count date information, and determine whether or not the operating condition of the compressor satisfies a preset low temperature condition when the current date is within a preset date range. For example, the date range may be set from November 1 through December 31, and January 1 through March 31.

Moreover, as illustrated in FIG. 8, when it is determined that the operating condition of the compressor satisfies a low temperature condition, the controller 25 may control the inverter to preheat the motor so that a DC current of a predetermined magnitude flows through the motor (S802).

At this time, the magnitude of the DC current applied to the motor may be variably set according to the design standard of the circuit illustrated in FIG. 4.

In one embodiment, the controller 25 may initially apply a DC current of a predetermined magnitude to the motor, and then adjust the magnitude of the DC current applied to the motor according to the motor voltage.

For example, the controller 25 may set a target DC current value for controlling the preheating operation of the motor, and control the inverter to increase an output voltage of the inverter when the motor current sensed by the sensing unit is smaller than the target DC current. The method of adjusting the DC current will be described in more detail in FIG. 13.

On the other hand, when the motor current sensed by the sensing unit is greater than a preset trip level after the DC current is applied to the motor, the controller 25 may cut off the output of the inverter. When an excessive magnitude of DC current flows through the motor, the risk of failure of the motor increases, and thus a trip level may be set to secure the stability of the motor preheating operation.

Referring to FIG. 8, the controller 25 may determine whether or not the preheating of the linear compressor is completed subsequent to applying a DC current to the motor (S803). The controller 25 may apply a DC current to the motor until it is determined that preheating is completed.

Figure 9:
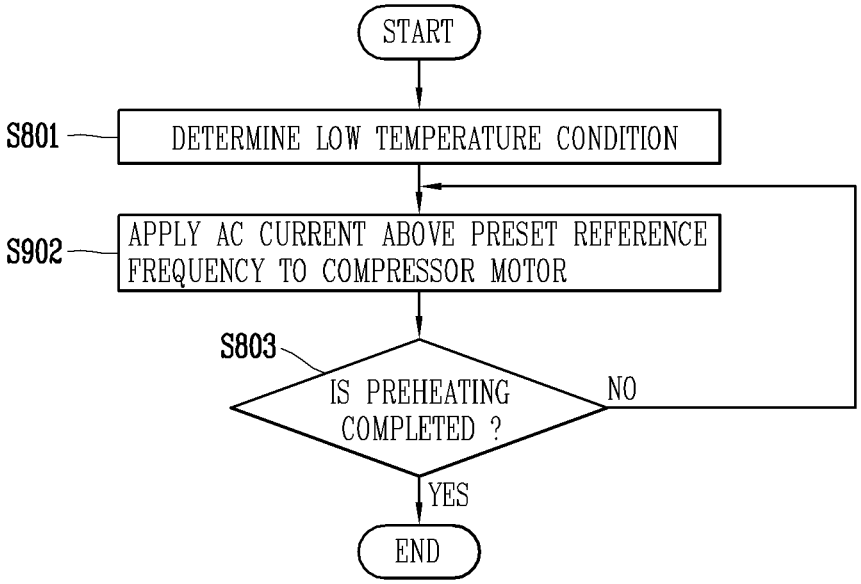
FIG. 9 is a flowchart showing a control method of a linear compressor according to the present disclosure.

In FIG. 9 below, another embodiment of the preheating operation for preheating the motor will be described.

As illustrated in FIG. 9, when the operating condition of the linear compressor satisfies a preset low temperature condition, the controller 25 may apply an AC current above a preset reference frequency to the motor (S901) to preheat the motor.

In other words, in contrast to the method illustrated in FIG. 8 in which the motor is preheated by applying a DC current, the method shown in FIG. 9 preheats the motor by applying a high-frequency current.

Similarly to the preheating method using the DC current, the controller 25 may determine whether or not the preheating of the linear compressor is completed after the high-frequency current is applied (S903).

The preheating operation of the motor according to the present disclosure is performed in a state where the piston is stopped before the linear compressor is operated in accordance with the operation command.

In other words, the controller 25 may apply a DC current or a high-frequency current to the motor so as to preheat the motor so that current flows through the motor while the piston is stopped.

Figure 10:
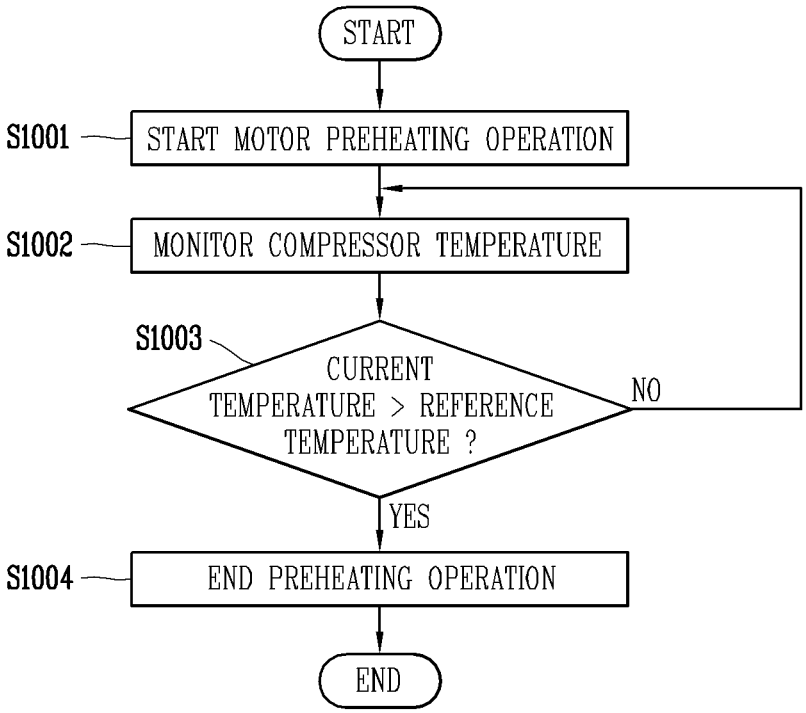
FIG. 10 is a flowchart showing a control method of a linear compressor according to the present disclosure.

In FIG. 10 below, an embodiment for determining whether or not the preheating operation is completed will be described.

Figure 11:
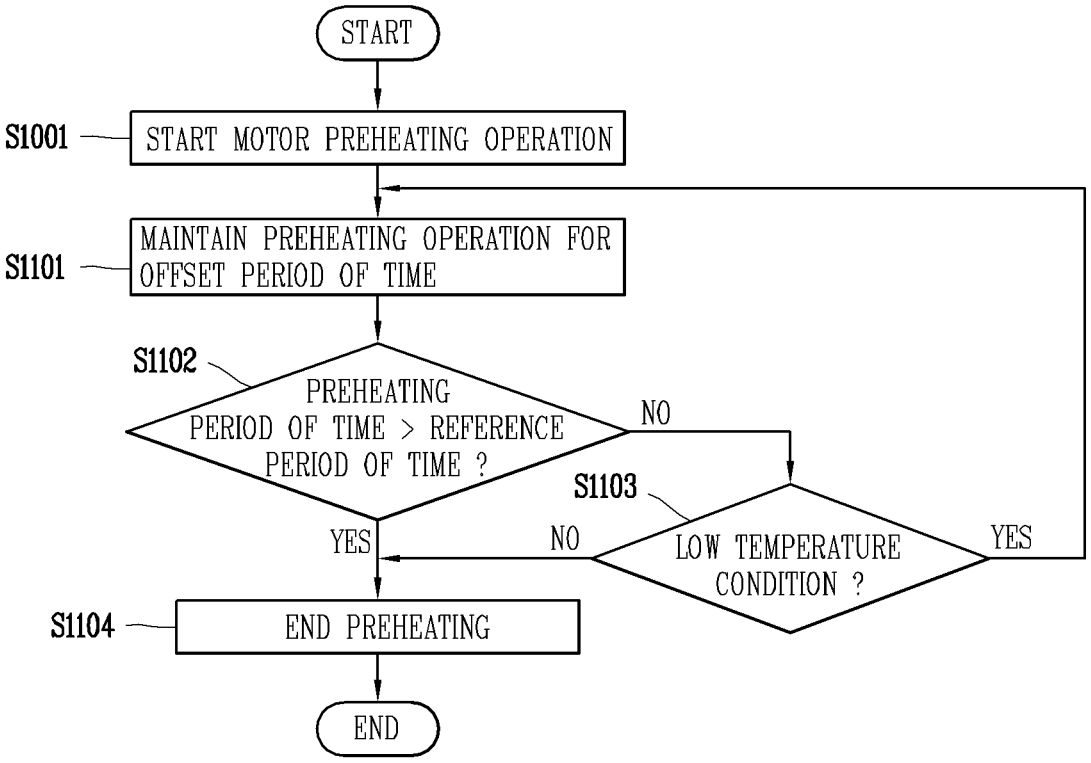
FIG. 11 is a flowchart showing a control method of a linear compressor according to the present disclosure.

In FIGS. 10 and 11, for convenience of explanation, it is assumed that the preheating operation of the motor is started (S1001).

Referring to FIG. 10, after the preheating operation of the motor is started, the controller 25 may monitor temperature information related to the linear compressor (S1002).

At this time, the temperature information to be monitored by the controller 25 may include a temperature value measured by a temperature sensor provided in the linear compressor by itself, a temperature value measured by a temperature sensor provided in the electronic device provided with the linear compressor, and a temperature value estimated by a resistance value of the motor measured by the controller.

The controller 25 may determine whether or not the current temperature of the linear compressor is greater than a preset reference temperature based on the monitored temperature information (S1003).

In FIG. 10, in determining whether or not the preheating operation is completed, the monitored temperature information and the reference temperature used in the process of initially determining whether or not it is in a low temperature condition are used once again. However, the present disclosure is not limited thereto, and the reference temperature may be used as another temperature value as a criterion for ending the preheating operation.

When it is determined that the current temperature is higher than the reference temperature, the controller 25 may end the preheating operation of the motor (S1004).

In FIG. 11 below, another embodiment for determining whether or not the preheating operation is completed will be described.

Referring to FIG. 11, the controller 25 may maintain the preheating operation of the motor for a preset offset period of time after the preheating operation of the motor is started (S1101).

By setting the offset period of time in this manner, even when a control error related to a preheating operation process occurs, the minimum preheating period of time may be secured.

The controller 25 may variably set the offset period of time based on the temperature information detected at the time when the preheating operation of the motor is started. In other words, the controller 25 may set a longer offset period of time as the preheating operation of the motor is started at a lower temperature.

Furthermore, when the offset period of time has elapsed since the start of the preheating operation of the motor, the controller 25 may determine whether or not the period of time of the preheating operation has passed a preset reference period of time (S1102).

When it is determined that the period of time of the preheating operation exceeds the reference period of time, the controller 25 may end the preheating operation (S1104).

On the other hand, when it is determined that the period of time of the preheating operation does not exceed the reference period of time, the controller 25 may determine whether or not the operating condition at the current time point satisfies a low temperature condition using the temperature information (S1103).

The low temperature condition determination process (S1103) is performed by comparing a temperature value detected through a plurality of methods with a preset reference temperature, as described above with reference to FIGS. 6 and 7.

When the operation condition of the current time point satisfies the low temperature condition, the controller 25 performs the process of maintaining the preheating operation for an offset period of time (S1101) again, and otherwise end the preheating operation (S1104).

On the other hand, the controller 25 may update the temperature information for each preset offset period of time after the preheating operation of the motor is started. Accordingly, in the process of determining whether or not the low temperature condition is satisfied (S1103), the controller 25 may determine whether or not preheating is further required using the latest updated temperature information.

In other words, referring to FIGS. 10 and 11, the controller 25 may determine whether or not to end the preheating operation using at least one of a duration of the preheating operation of the motor and a current temperature of the motor.

Figure 12:
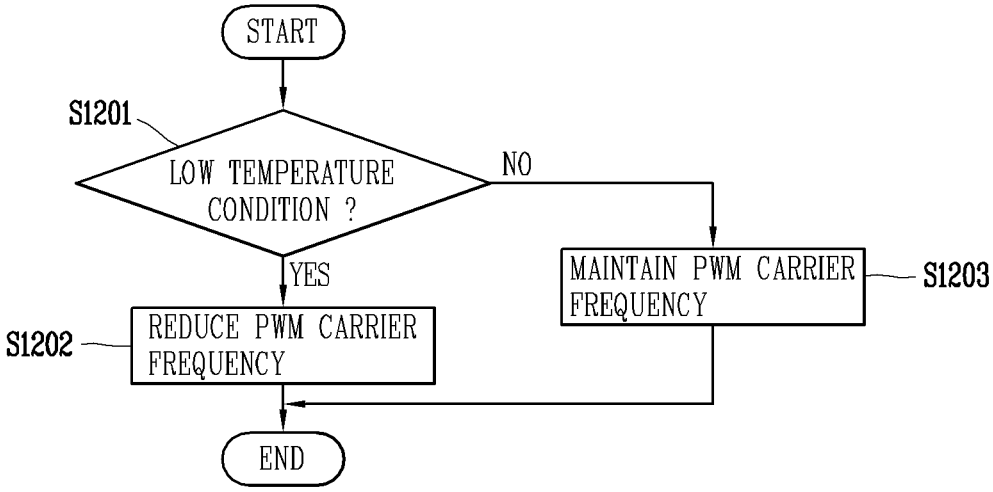
FIG. 12 is a flowchart showing a control method of a linear compressor according to the present disclosure.

In FIG. 12 below, a method of controlling the inverter when performing the preheating operation of the motor will be described.

As illustrated in FIG. 12, the controller 25 may determine whether or not the operating condition of the linear compressor satisfies a low temperature condition (S1201). The low temperature condition determination process (S1201) is performed by comparing a temperature value detected through a plurality of methods with a preset reference temperature, as described above with reference to FIGS. 6 and 7.

When it is determined that the operating condition of the linear compressor satisfies the preset low temperature condition, the controller 25 may reduce a carrier frequency of the inverter (S1202).

On the contrary, when it is determined that the operating condition of the linear compressor does not satisfy the preset low temperature condition, the controller 25 may maintain the carrier frequency of the inverter (S1203).

In one embodiment, the controller 25 may reduce the carrier frequency applied to the inverter to a value smaller than the initially set value when the detected temperature value with regard to the linear compressor is smaller than the reference temperature. In other words, when it is determined that the preheating operation of the motor is required, the controller 25 may reduce the carrier frequency applied to the inverter to a value smaller than the initially set value.

In another embodiment, when a DC current is applied to the motor to preheat the motor, the controller 25 may reduce the carrier frequency applied to the inverter to a value smaller than the initially set value.

In this manner, by reducing the carrier frequency applied to the inverter when the controller preheats the motor, the sensing unit may more accurately sense the motor current during the preheating operation of the motor. In other words, as the carrier frequency is reduced, the controller 25 may secure an effect of relatively increasing a pulse width modulation (PWM) duty value applied during the preheating operation of the motor. As described above, as the PWM duty value relatively increases, a current signal may be stabilized at the time of sensing the current to reduce the sensing error.

Figure 13:
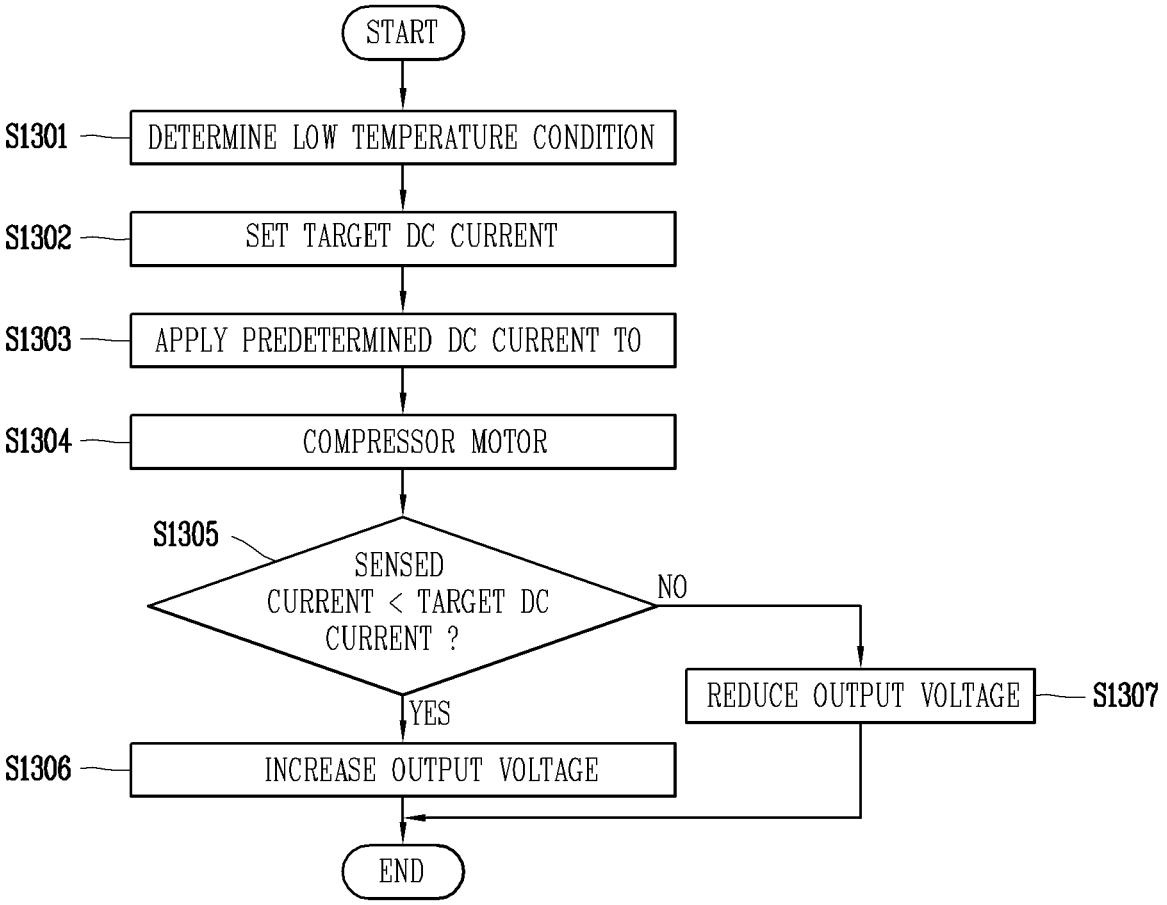
FIG. 13 is a flowchart showing a control method of a linear compressor according to the present disclosure.

In FIG. 13, a method of preheating the motor using the DC current will be described.

As illustrated in FIG. 13, the controller 25 may determine whether or not the operating condition of the linear compressor satisfies a low temperature condition (S1301). The low temperature condition determination process (S1301) is performed by comparing a temperature value detected through a plurality of methods with a preset reference temperature, as described above with reference to FIGS. 6 and 7.

When it is determined that the operating condition of the linear compressor satisfies the preset low temperature condition, the controller 25 may set a target DC current value (S1302).

At this time, the controller 25 may set the target DC current value based on information related to the control circuit of the linear compressor.

The controller 25 may control the inverter to apply a predetermined DC current to the motor (S1303).

In addition, the controller 25 may control the sensing unit to sense the motor current (S1304).

The controller 25 may compare a magnitude of the detected current with a magnitude of the target DC current (S1305), and when the magnitude of the sensed current is smaller than the target DC current, the controller 25 may increase an output voltage of the inverter (S1306). On the contrary, when the magnitude of the sensed current is above the target DC current, the controller 25 may reduce the output voltage of the inverter (S1307).

Figure 14:
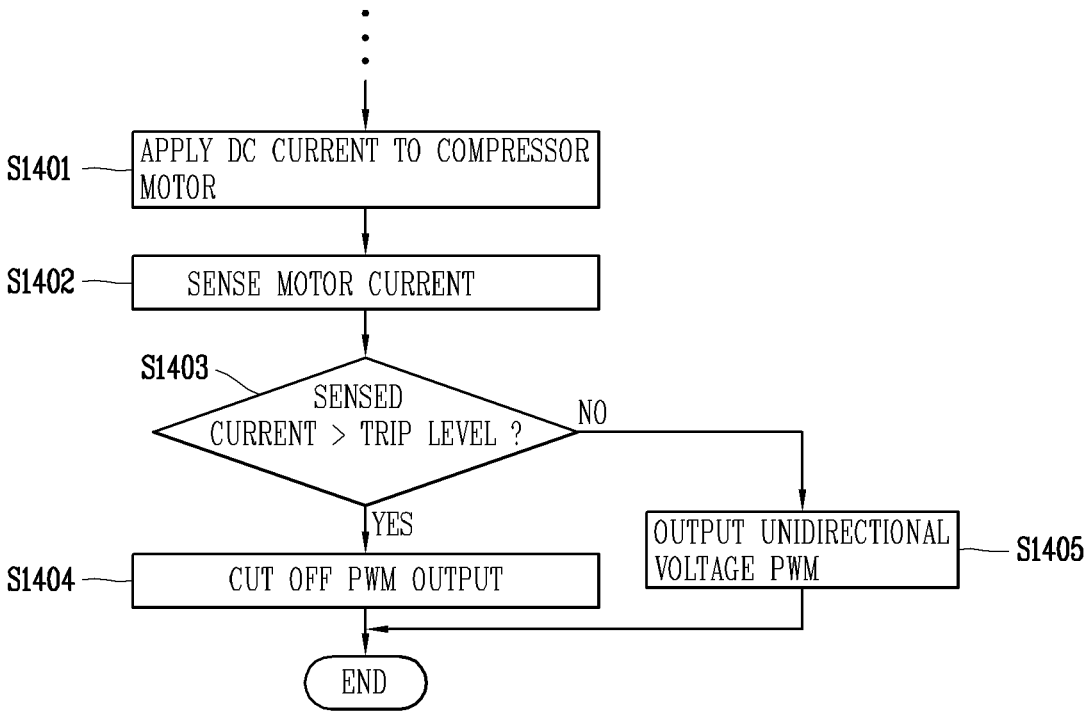
FIG. 14 is a flowchart showing a control method of a linear compressor according to the present disclosure.

In FIG. 14 below, a condition for ending the preheating of the motor will be described.

The controller 25 may control the inverter to apply a DC current to the motor in order to preheat the motor in a low temperature condition (S1401).

After the inverter applies the output voltage to the motor, the controller 25 may control the sensing unit to sense the motor current flowing through the motor (S1402).

The controller 25 may determine whether or not the sensed motor current is higher than a preset trip level (S1403). At this time, the trip level is defined as a current value.

When it is determined that the sensed motor current is higher than the trip level, the controller 25 may cut off the output of the inverter (S1404). When it is determined that the sensed motor current is lower than the trip level, the controller 25 may maintain the output of the inverter (S1405).

In other words, when the motor current flowing through the motor is higher than a preset trip level, the controller 25 may stop the preheating operation of the motor. As described above, by setting the trip level in advance, it is possible to prevent an overcurrent from flowing to the motor by the preheating operation.

The linear compressor according to the present disclosure performs a preheating operation prior to performing a reciprocating movement of the piston, thereby obtaining an effect of preventing a groove formed in the cylinder from being clogged.

Furthermore, according to the present disclosure, a preheating operation for increasing the temperature of the linear compressor prior to moving the piston of the linear compressor may be carried out, thereby preventing friction or collision between the piston and the cylinder.

Accordingly, the linear compressor according to the present disclosure has an advantage capable of securing the operation performance of the compressor even under a low temperature condition.

In addition, according to the present disclosure, the performance of the gas bearing may be secured to minimize the wear of the piston, thereby obtaining an effect of increasing the life of the mechanism and parts of the linear compressor.

What is claimed is:

1. A linear compressor provided to an electronic device, the linear compressor comprising:

a cylinder that defines at least one groove;

a piston configured to reciprocate within the cylinder;

a motor configured to generate a driving force and to drive the piston to reciprocate within the cylinder;

an inverter configured to perform a switching operation and to transmit electric power to the motor; and a controller configured to receive temperature information related to a temperature of the linear compressor from the electronic device and to control the inverter to preheat the motor based on the temperature information, wherein the controller is configured to, based on activation of the electronic device, control a preheating operation of the motor to increase the temperature of the linear compressor in a state in which the piston is stopped, wherein the controller is further configured to, in response to a control command for starting operation of the linear compressor, determine whether or not to preheat the motor based on the temperature information that is received within a predetermined period of time elapsed from a time instant corresponding to generation of the control command.

2. The linear compressor of claim 1, wherein the controller is further configured to control the inverter to allow a DC current having a predetermined magnitude to flow through the motor to thereby preheat the motor.

3. The linear compressor of claim 2, further comprising:

a sensor configured to sense a motor current flowing through the motor, wherein the controller is further configured to, based on applying the DC current to the motor, adjust an output voltage of the inverter according to the motor current sensed by the sensor.

4. The linear compressor of claim 3, wherein the controller is further configured to:

set a target DC current value for controlling the preheating operation of the motor; and control the inverter to increase the output voltage of the inverter based on the motor current sensed by the sensor being less than the target DC current value.

5. The linear compressor of claim 3, wherein the controller is further configured to control the inverter to block the output voltage of the inverter based on the motor current sensed by the sensor being greater than a preset trip level.

6. The linear compressor of claim 1, wherein the controller is further configured to control the inverter to allow an AC current having a frequency greater than a preset reference frequency to flow through the motor to thereby preheat the motor.

7. The linear compressor of claim 1, wherein the temperature information comprises a temperature value related to a location of the electronic device, and wherein the controller is further configured to compare the temperature value to a preset reference temperature and to perform the preheating operation of the motor based on a comparison result of the temperature value to the preset reference temperature.

8. The linear compressor of claim 7, wherein the temperature value is measured by a temperature sensor of the electronic device, and wherein the controller is further configured to, based on the temperature value being less than the preset reference temperature, preheat the motor prior to operating the motor according to a predetermined compressor command.

9. The linear compressor of claim 7, wherein the controller is further configured to receive the temperature information from any one of a plurality of temperature sensors of the electronic device, the one of the plurality of temperature sensors being disposed closest to the linear compressor among the plurality of temperature sensors.

10. The linear compressor of claim 7, wherein the controller is further configured to:

update the temperature information based on a predetermined preheating duration being elapsed after a start of the preheating operation of the motor; and stop the preheating operation of the motor based on a comparison result of an updated temperature value included in the updated temperature information to the preset reference temperature.

11. The linear compressor of claim 7, wherein the controller is further configured to stop the preheating operation of the motor based on a duration of the preheating operation of the motor exceeding a preset reference period of time.

12. The linear compressor of claim 7, wherein the controller is further configured to decrease a carrier frequency applied to the inverter based on the temperature value being less than the preset reference temperature.

13. The linear compressor of claim 7, wherein the controller is further configured to, based on the temperature value being greater than the preset reference temperature, control the inverter to allow the piston to reciprocate within the cylinder according to an operation mode of the electronic device without performing the preheating operation of the motor.

14. The linear compressor of claim 1, wherein the controller is further configured to, based on a completion of preheating of the motor, control the inverter to allow the piston to reciprocate within the cylinder according to an operation mode of the electronic device.

* * * * *